United States Patent [19]

Hemphill

[11] 4,449,309

[45] May 22, 1984

[54] FLAT BOTTOM BUCKET AND DIGGING TEETH

[75] Inventor: Charles W. Hemphill, Duncanville, Tex.

[73] Assignee: GH Hensley Industries, Inc., Dallas, Tex.

[21] Appl. No.: 17,443

[22] Filed: Mar. 5, 1979

[51] Int. Cl.[3] ..... E02F 9/28

[52] U.S. Cl. ..... 37/141 R; 37/141 T; 37/142 R; 172/686

[58] Field of Search ..... 37/141 R, 141 T, 142 R, 37/142 A, 135; 414/722; 172/719, 726, 686

[56] References Cited

U.S. PATENT DOCUMENTS

| | | | |
|---|---|---|---|
| 802,036 | 10/1905 | French | 172/726 |
| 1,197,104 | 9/1916 | Clark, Jr. | 37/142 R |
| 1,545,621 | 7/1925 | Turner | 37/141 T |
| 1,573,137 | 2/1926 | Brannon | 37/141 T |
| 1,696,924 | 1/1929 | Rorabeck | 37/142 R |
| 1,796,737 | 3/1931 | Van Buskirk | 37/142 R |
| 1,804,756 | 5/1931 | Elwood | 37/142 R |
| 1,989,776 | 2/1935 | Weimer | 37/141 T |
| 2,211,786 | 8/1940 | Lehman et al. | 37/141 T |
| 3,243,906 | 4/1966 | Washbond | 37/141 R |
| 3,497,973 | 3/1970 | Campbell | 172/719 X |
| 3,775,879 | 12/1973 | Quick | 37/141 T X |
| 3,914,885 | 10/1975 | Moreau | 172/719 X |
| 4,127,952 | 12/1978 | Chamberlain | 37/141 R |
| 4,133,121 | 1/1979 | Hemphill | 37/118 R |

FOREIGN PATENT DOCUMENTS

| | | | |
|---|---|---|---|
| 1097738 | 1/1961 | Fed. Rep. of Germany | 172/686 |
| 553954 | 6/1943 | United Kingdom | 37/135 |

*Primary Examiner*—Steven A. Bratlie

*Attorney, Agent, or Firm*—Hubbard, Thurman, Turner & Tucker

[57] ABSTRACT

An excavating bucket having spaced sides attached to a rear wall and a flat bottom which lies in a curved plane. The sides and rear are joined to the bottom, and the bucket opening has a periphery defined by the upper edge portion of the rear wall, sides, and the forward edge of the bottom. The marginal, forward end of the bottom is in the form of a bucket lip. A plurality of digging teeth are mounted to the forward end of the lip and arranged respective to one another to provide a continuous cutting edge from one to the other side of the bucket. The geometrical configuration of the digging teeth, together with the bucket design and tooth distribution pattern, increases the digging efficiency and provides a smooth excavated surface.

18 Claims, 11 Drawing Figures

FIG. 6
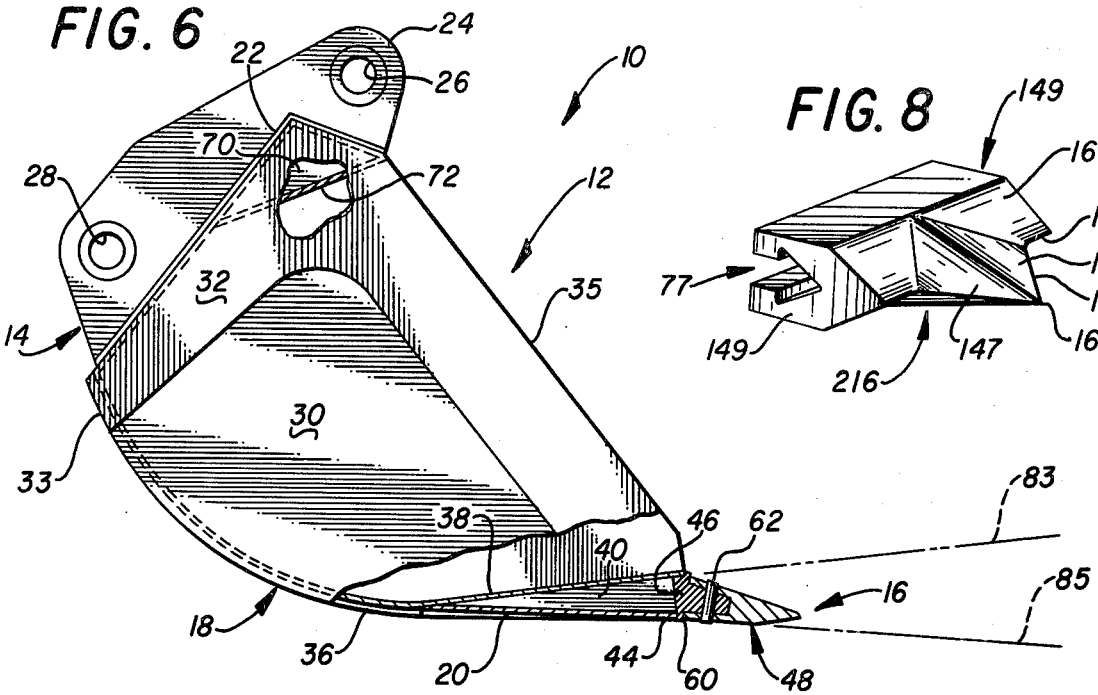
FIG. 8
FIG. 7
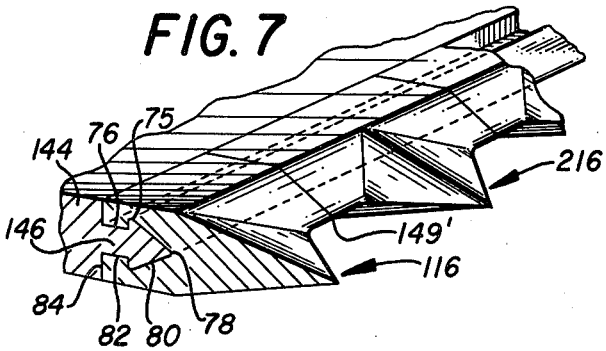
FIG. 9
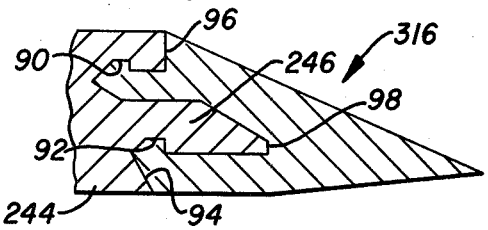
FIG. 11
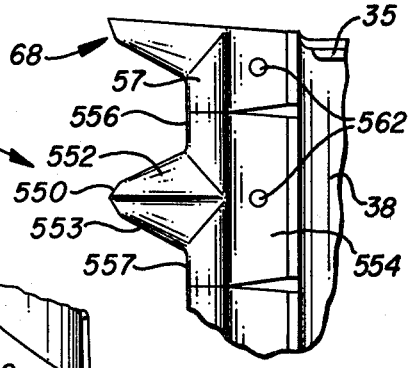
FIG. 10
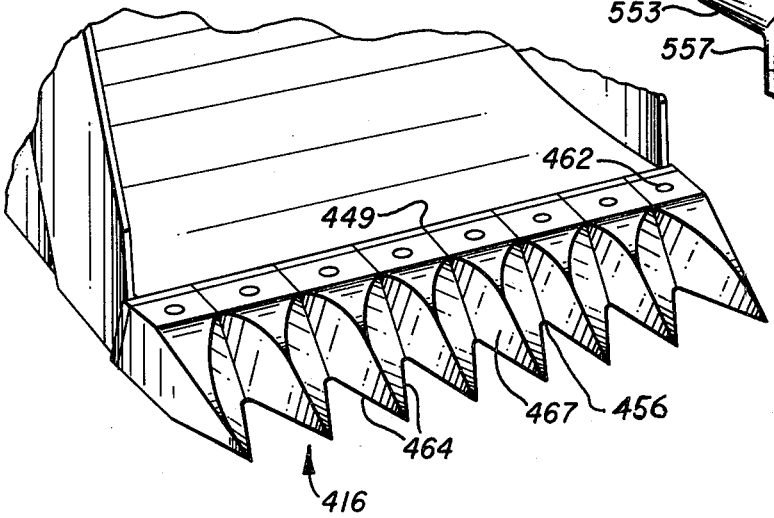

FLAT BOTTOM BUCKET AND DIGGING TEETH

BACKGROUND OF THE INVENTION

Reference is made to my previously issued U.S. Pat. No. 4,037,337 and to the art cited therein for additional background of this invention. Reference is also made to my co-pending patent application Ser. No. 817,733 filed July 21, 1977 now U.S. Pat. No. 4,133,121.

In digging ditches, it is sometime necessary to form the bottom of the ditch into a flat surface which often must be held within considerably close tolerance with regard to the deviation thereof from a horizontal plane. Simultaneously with the forming of a flat bottom ditch, it is also often desirable that the opposed sidewalls of the ditch immediately adjacent the bottom be cut exactly vertical with any irregularities therein being minimized. The foregoing desirable ditch is difficult to achieve using prior art excavating bucket and backhoe combinations.

It is furthermore desirable for one to be able to easily position the bucket such that the digging teeth thereof penetrate the earth at the optimum cutting angle. Another desirable feature often associated with buckets is for the structural integrity thereof to be sufficient to enable efficient operation with a minimum of downtime for repairs. It would also be desirable to provide a bucket made into a configuration which enables it to carry a considerable volume of excavated material on the top thereof, thereby greatly increasing the actual payload of the bucket well beyond its actual displacement. In addition, it would be advantageous to have made available an improved digging tooth which encounters and excavates earth more efficiently than heretofore realized, and wherein the teeth can be easily changed in the field without employment of special tools.

The above desirable attributes are the subject of this invention.

SUMMARY OF THE INVENTION

A backhoe bucket having spaced sides attached to a rear wall and to a flat bottom. The bottom lies in a curved plane and is attached to the sides and the rear in such a manner that the cross-sectional area of the bucket increases in an upward direction and towards the opening of the bucket.

The bucket opening is described by one side edge portion of the bottom, sides, and rear wall. The rear of the bucket is provided with lift means by which the bucket can be removably attached to the dipper stick receptacle of a backhoe and manipulated in a digging manner. The forward marginal end of the bucket terminates in a bucket lip to which a plurality of digging teeth are removably mounted in a novel manner. The lip forms the forward marginal end portion of the bottom and extends from one sidewall to the other sidewall of the bucket.

Each of the centrally located digging teeth are provided with a primary earth-engaging member which extends in advance of a secondary earth engaging member, with each of the primary members being separated from one another by the secondary members and vice versa.

In one embodiment of the invention, the secondary earth engaging members are placed into abutting engagement with respect to one another.

In another embodiment of the invention, the outermost teeth are mirror images of one another while a plurality of teeth located therebetween are arranged such that adjacent teeth are mirror images of each other and hence alternant teeth are identical to each other.

The bottom of the bucket lies in a plane which is curved in a forward and rearward direction, and which lies horizontally in a lateral direction. The bottom is curved in such a manner that the optimum digging angle is easily achieved by slightly raising the rear of the bucket respective to the digging teeth.

The configuration of the digging teeth cooperates with the design of the bucket to provide an improved bucket and tooth combination which complement one another to bring about unexpected advantages in the excavation art.

Critical components of the bucket are fabricated of boxed construction which provides the required structural integrity to enable the transfer of loads from the digging teeth back to the lifting means, and it is believed that this load transfer occurs in an improved manner.

Accordingly, a primary object of the present invention is the provision of an improved backhoe bucket which excavates material from the earth in such a manner that a smooth surface is obtained at the bottom of the excavation.

Another object of the invention is to provide an improved bucket which carries a considerable amount of its payload externally or on top of the bucket.

A further object of this invention is to disclose and provide an improved bucket and tooth combination which enable excavation to be achieved across the entire width of the bucket.

A still further object of this invention is to provide an excavating bucket having digging teeth arranged thereon which enables the removal of earth to be carried out in a superior manner, thereby significantly reducing the cost of the excavation operation.

Another and still further object of the present invention is the provision of an improved digging bucket having the bottom and the teeth thereof arranged respective to one another such that the bucket is easily manipulated into or placed at the optimum digging angle thereof.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

BRIEF DESCRIPTION OF THE DRAWINGS

FIG. 6 is a side elevational view of the bucket disclosed in the foregoing figures, with some parts being broken away therefrom, and some of the remaining parts being shown in cross-section;

FIG. 7 is a fragmentary, part cross-sectional, perspective view of a modification of part of the apparatus disclosed in the foregoing figures;

FIG. 8 is an isolated, perspective view of part of the apparatus disclosed in FIG. 7;

FIG. 9 is a cross-sectional view of another modification of the apparatus disclosed in FIGS. 7 and 8;

FIG. 10 is a broken, perspective view of another modification of the present invention; and, FIG. 11 is a fragmentary, top plan view of still another embodiment of the invention.

DETAILED DESCRIPTION OF THE PREFERRED EMBODIMENTS

Figure 1:
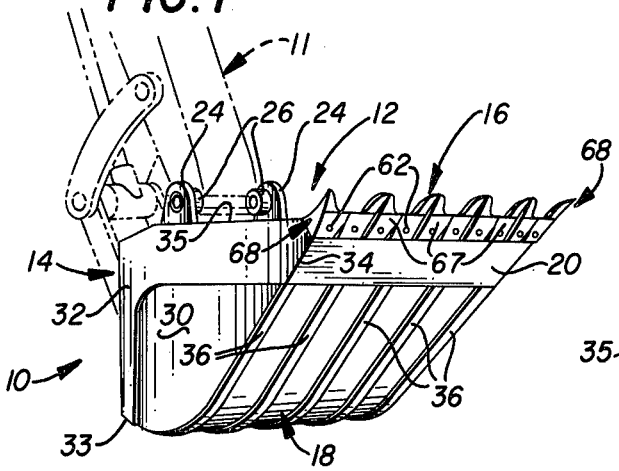
FIG. 1 is a perspective view of a digging bucket apparatus made in accordance with the present invention.

In FIG. 1, together with various other figures of the drawings, there is disclosed an excavating bucket 10 made in accordance with the present invention. The bucket is illustrated in attached relationship respective to a dipper stick such as may be associated with a backhoe machine, as indicated by the dot-dash lines at numeral 11.

The bucket has an interior 12 into which excavated material is received during the excavating operation. The rear 14 of the bucket is spaced from the forward digging part of the bucket, and a plurality of digging teeth 16 form the forwardmost part of the bucket.

The bottom 18 of the bucket is in the form of a flat, curved member which commences at the rear and curves slightly downwardly and then upwardly toward a bucket lip 20, to which the before mentioned digging teeth are mounted.

Figure 2:
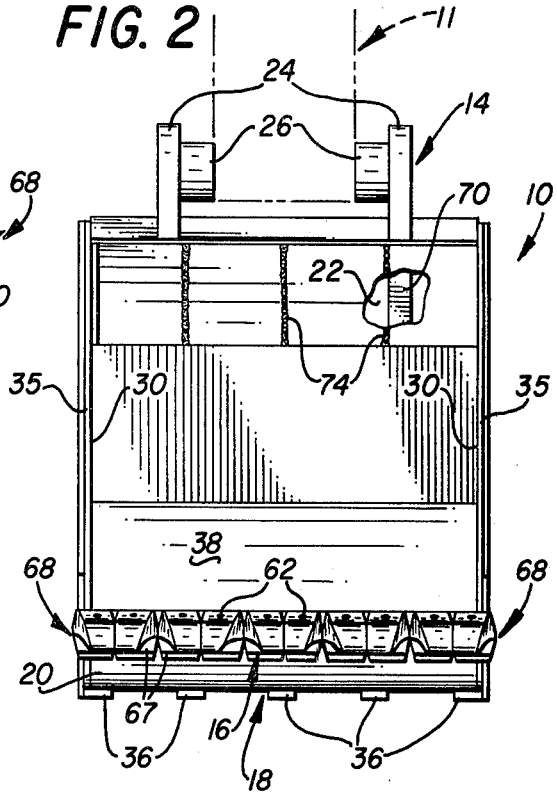
FIG. 2 is a front elevation view of the bucket illustrated in FIG. 1 with some parts being broken away therefrom.
Figure 5:
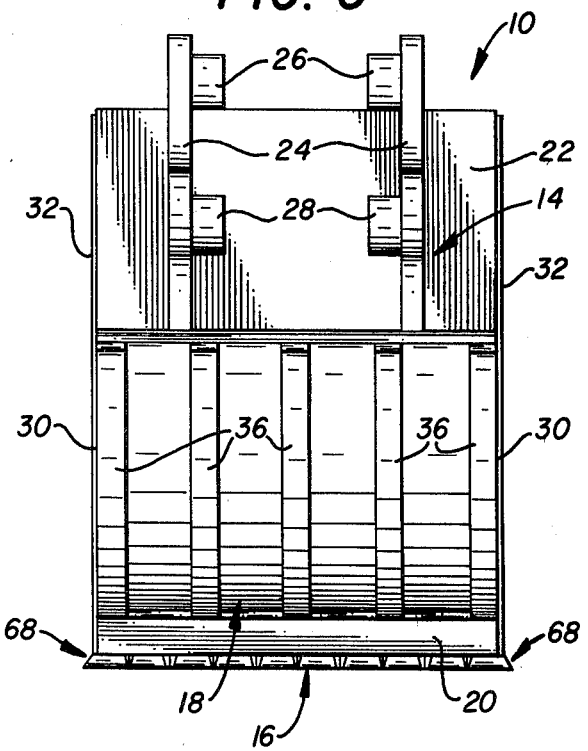
FIG. 5 is a rear view of the bucket disclosed in the foregoing figures.

As best seen in FIGS. 2 and 5, the back 22 of the rear wall is attached to lifting means which are in the form of vertically disposed spaced ears 24 having bushings 26 and 28 associated therewith, preferably in accordance with my previously filed patent application Ser. No. 817,733, filed July 21, 1977.

Spaced, opposed, sidewalls 30 are preferably arranged substantially parallel to one another and disposed in spaced vertical planes. The sidewalls are reinforced by the L-shaped or anglelike member 32. The angle member has one edge portion attached to the lip, a rear edge portion attached to the back, with end portion 33 terminating along the curved bottom, as best seen illustrated in FIGS. 1 and 6.

Numeral 34 indicates the juncture between members 32 and 20. The upper edge portion 35 of the angle member is sharpened into a knife edge to aid in trimming and maintaining vertical walls of a ditch, for example.

Longitudinally disposed wear members 36 extend from the lip to the rear wall of the bucket and assist in reinforcing the bottom of the bucket. The upper surface 38 of the bottom of the bucket is spaced from the bucket lip 20 by a plurality of web members 40. The web members are vertically disposed and extend longitudinally of the bucket. The upper and lower opposed edges of the web members tie the upper surface 38 and lip 20 together by welding 42 seen illustrated in FIG. 3. The web members extend into attached relationship with respect to member 44 to provide a load transfer member for a plurality of spaced-apart, tooth receiving shanks 46.

Figure 3:
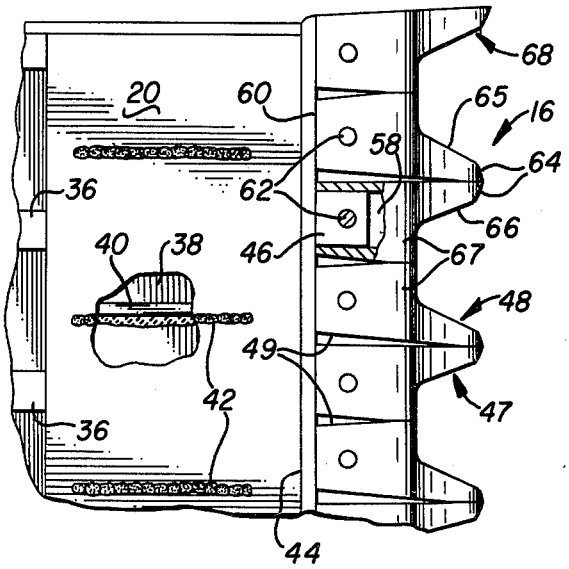
FIG. 3 is a fragmentary, bottom view of the bucket disclosed in the foregoing figures with some parts thereof being removed therefrom, and some of the remaining parts being shown in cross-section.
Figure 4:
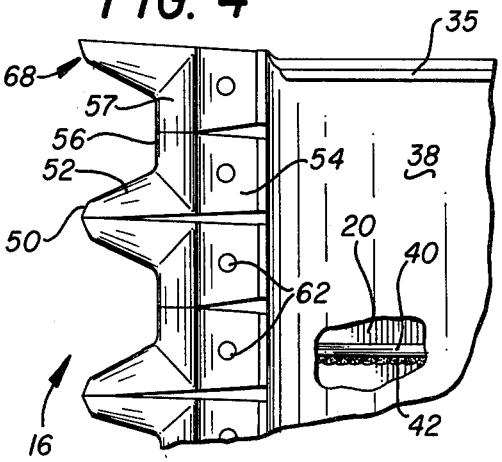
FIG. 4 is a fragmentary, top view of the bucket disclosed in the foregoing figures, with some parts being removed therefrom.

As seen in the embodiment of FIGS. 2–4, the plurality of digging teeth 16 are comprised of two adjacent teeth 47 and 48, which are mirror images of one another. The teeth are arranged with the sides thereof abutting one another such that their cooperative action jointly provides a common penetrating member 50, which slopes upwardly at 52 in a rearward direction towards a shank receiving cavity formed within the rear marginal end 54 thereof. Each of the teeth 47 and 48 further include a secondary digging member 56 and 57 which cooperates together to provide a secondary earth-engaging member between adjacent primary members 50.

As seen in FIGS. 3 and 4, a cavity 58 is formed within the rear marginal portion 54 of each of the teeth to enable the shank to be received in close tolerance relationship therewithin. The rear 60 of the tooth abuttingly engages member 44 of the bucket lip, while pins 62 form a fastener means by which the individual teeth are removably mounted to the shank and hence to the lip of the bucket.

As seen in FIG. 3, together with FIGS. 2 and 4, the forwardmost end 64 of adjacent digging teeth curves outwardly away from one another to form diagonal cutting edges 65 and 66. The penetrating member 64, 66 downwardly slopes towards the cutting edge of secondary members 67. The sloped face of 67 continues in an upward and rearward direction. The opposed outermost digging teeth 68 are mirror images of one another. The teeth are outwardly directed in a forward direction, thereby extending the cutting action of the tooth outwardly of each of the vertical walls 30.

As seen in FIG. 6, a plurality of web members 70 are interposed between the outer rear wall 22 and inner rear wall 72, with two of the web members being positioned in aligned relationship respective to the spaced ears 24, thereby transferring the tremendous load from the lifting member into each of the spaced wall members of the bucket. Numeral 74 indicates welding by which the web members are affixed to the spaced wall members 22 and 72.

In FIGS. 7 and 8, there is disclosed a modification of the digging teeth presented in the foregoing figures. The cutting edge of the bucket of FIG. 7 includes identical intermediate teeth 216 while the outermost teeth located on either side of the cutting edge are mirror images of one another. The bucket lip extends forwardly into an enlargement 75 which reduces or necks down at 76 and again enlarges at 144. The tooth includes a female, laterally extending cavity 77 which is made complementary respective to the enlargement 75, with the enlargement and cavity being similar to a tongue and groove, wherein the groove slidably receives the tongue in close tolerance relationship therewith.

The cavity 77 similarly is provided with wall surfaces 80, 82, and 84, which are sized to receive elements 75, 76, and 78 therewithin such that the individual teeth may be assembled to the bucket lip by slidably mating the female cavity 77 with respect to the laterally extending enlargement 75, 76 in a telescoping manner.

End portions 149 of the individual teeth abuttingly engage one another to provide the interface seen at 149'. The teeth cooperate together to provide a secondary cutting edge 156 rearwardly spaced from a primary member 164. The primary member includes sloped sides 147, 148 which downwardly slope at 148 into a cutting edge 165. The cutting edge forms a diagonal which intersects the cutting edge 156 of the secondary member.

In FIG. 6, numeral 83 indicates the plane within which the forward portion of the bucket bottom lies, while numeral 85 indicates the digging angle automatically achieved when the bucket is placed such that the bottom of the teeth and the bucket bottom 20 simultaneously contact the ground.

In FIG. 10, there is disclosed the before-illustrated digging bucket having teeth 416 made in accordance with still another embodiment of this invention. The teeth are provided with a forwardly directed penetrating member having sloped walls 467 which terminate in cutting edges 464. The penetrating members rearwardly slope towards a V-shaped secondary cutting member 456. The intermediate teeth are identical to one another, while the two outermost teeth are mirror images of one another. Numeral 449 indicates the interface between adjacent teeth 416. The teeth may be individually fastened to a shank as suggested in FIG. 10, or alternatively the teeth may be attached to the bucket lip in the illustrated manner of FIGS. 7 and 9.

In the embodiment shown in FIG. 11, the teeth 516 include the opposed outermost teeth 68, each of which include the illustrated primary and secondary members. The primary member curves outwardly away from the bucket in a forward direction, and includes the illustrated cutting edge which is placed at an angle. The face 57 of the secondary member slopes upward towards the fastener means 562 while the face of the primary member slopes upwardly and rearwardly.

The centrally located teeth include a primary member 550 having opposed ground engaging faces 552 and 553 which slope towards opposed secondary members 556 and 557. The tooth shank 554 is secured to the bucket lip in the manner taught in either of the foregoing embodiments. The centrally located teeth 516 are identical to one another and cooperate with the other teeth to provide a continuous cutting edge across the entire width of the bucket.

OPERATION

In operation, the excavating bucket of the present invention is attached to a digging implement, such as the dipper stick 11 of a backhoe machine. The flat bottom bucket has a continuous cutting edge which extends beyond the sides 30 thereof, while the edge portion 35 which forms part of the peripheral opening into the bucket is sharpened into a blade member. Accordingly, when the bucket is positioned as seen in FIG. 6, the bottom 20 and teeth 16 can be positioned respective to the ground to cause movement of the bucket in a forward direction to force the continuous, cutting edge to engage the ground at the optimum angle for forming a continuous smooth surface or excavation of minimum irregularities. Simultaneously with forming a smooth bottom of a ditch or the like, the edges 35 engage the sidewalls of the ditch and remove irregularities therefrom.

The angle bracket 32 efficiently transfers the load between the digging teeth and the liting means. The boxed construction seen at 38, 40, and 44 reinforces the marginal front end of the bucket and enables tremendous power to be transferred from the dipper stick into the teeth.

In FIG. 3, adjacent teeth are mirror images of one another and cooperate together to form a penetrating member 50 in advance of a secondary member 56. Alternatively, the teeth set forth in the embodiment of FIG. 7 may be employed. The tteth of FIG. 7 are easily mounted by merely telescoping the enlargement 80 within the cavity 77 and pinning the two outermost teeth. Where deemed desirable, each of the teeth may be individually pinned in the manner of FIG. 10.

In the embodiment of the bucket apparatus disclosed in FIG. 9, the tooth 316 is mounted to the bucket lip 244 by a complex tongue and groove arrangement which incudes spaced parallel grooves within which spaced, parallel, complementary tongues are slidably received. The male and female elements at 90 and 92, which constitute the tongue and groove, lock the teeth into proper position while abutting edge portions 94 and 96, respectively, transfer upward and downward loads, respectively, imposed on the tooth. The forwardly directed member 98 maintains the teeth in proper alignment respective to one another. The teeth of FIG. 9 are slidably received by the complementary configured lip or shank, with the adjacent teeth being held in abutting relationship respective to one another and to the bucket lip by pinning the outermost teeth in the before described manner.

I claim:

1. A digging bucket having spaced sides, a rear wall, and a flat bottom which lies in a plane at the forward marginal end thereof and then curves into joined relationship respective to the rear wall;

the sides and rear wall are joined together and to the bottom, with the bucket having an opening defined by the edges of a peripheral wall surface which includes the edges of the spaced sides and rear wall;

the forward marginal end of the bottom is in the form of a tooth supporting lip, lift means attached to the bucket by which the bucket can be manipulated;

said lip having opposed ends joined to said spaced sides, a plurality of teeth, means by which said teeth are mounted to the lip, each of said teeth includes a primary digging member and a secondary digging member, said primary digging member extends in advance of said secondary digging member; adjacent teeth are mirror images of one another; said teeth are positioned laterally respective to one another and substantially abut each other; the primary digging members of some adjacent teeth abuttingly engage one another and cooperate together to present a single forward directed digging member; the secondary digging members of other adjacent teeth abuttingly engage one another and cooperate together to present a rearward cutting edge which lies rearwardly of the single forward directed digging member; the cutting edges of said forwardly directed digging member and said rearward cutting edge jointly cooperate together to form a continuous cutting edge which extends across the entire width of the bucket;

so that when the bucket is moved in a forward direction, the teeth can jointly engage and remove material from the earth and cause the removed earth to be received within the bucket; while the forward edge of the bucket lip is precluded from engaging the ground.

2. The bucket of claim 1 wherein alternant teeth are identical to one another.

3. The bucket of claim 1 wherein the outermost teeth are mirror images of one another and there are a plurality of teeth located between the outermost teeth, each said rearward cutting edge of pairs of teeth located between the outermost teeth is spaced from another rearward cutting edge by a forward directed digging member; the cutting edge of the bucket commences at the beginning of one primary member and continues as a continuous cutting edge across all of the teeth and to the termination of the primary member of the last tooth, there being a primary member on a tooth at each opposed side of the bucket lip.

4. The bucket of claim 1 wherein said bottom extends forwardly from said rear wall and forwardly curves toward said bucket lip; said lip and said teeth being arranged respective to one another and to said bottom such that when said bucket is set down with the teeth and bottom engaging the ground, said teeth are disposed along a common plane with the cutting edge thereof being placed in close proximity to the ground so that the bucket can be positioned such that forward movement thereof causes the teeth to engage the ground and excavate material therefrom.

5. The bucket of claim 1 wherein said bucket lip includes an elongated, unitary, tooth supporting member placed laterally respective to the digging movement of the bucket and extending from substantially one side to the other of the bucket;

said digging teeth and said tooth supporting member being of a configuration which enables said plurality of teeth to be mounted in a removable manner on said bucket lip.

6. The bucket of claim 1 wherein said lip is of boxed construction and includes an inner and outer wall having forward lateral edges spaced from one another, and rear lateral edges connected together, and a plurality of web members; the web members being vertically disposed and extending longitudinally of the bucket and connecting the inner and outer walls together.

7. The bucket of claim 6 and further including angle members affixed to opposed sides of the bucket and defining the outer edges of each said sidewall; there being one edge of said angle member affixed to said lip, another edge of said angle member is attached to said bottom, and still another edge of said angle member is attached to said rear wall;

the edge of the angle member which coincides with the edge of the bucket sidewalls being reduced in thickness to form a sharp cutting edge for trimming the sides of a ditch.

8. Excavating apparatus comprising an excavating bucket opened at the front and along the top thereof, and having a forward bottom marginal edge in the form of a tooth supporting bucket lip for detachably receiving a plurality of individual digging teeth thereon;

said teeth being arranged in side by side relationship, said teeth being arranged in pairs with adjacent teeth being mirror images of one another; each tooth has a marginal forward end made into a cutting edge for engaging and excavating the ground, and a rear marginal mounting end by which the teeth are individually mounted to the bucket lip; the forward cutting edges of the teeth cooperate together and extend across said forward bottom marginal edge to provide a continuous cutting edge which prevents the bucket lip from engaging material to be excavated;

the marginal forward end of each tooth includes a pilot member and a secondary member, said pilot member extends in advance of said secondary member thereby providing an advance and rear cutting edge which cooperate together to form part of the aforesaid continuous cutting edge; one pair of adjacent teeth have the pilot members thereof placed in close proximity of one another so that the pilot members thereof jointly function as a single forwardly directed digging member;

other adjacent teeth are arranged with the secondary members thereof placed in close proximity of one another so that the secondary members thereof jointly function as a digging member which is positioned rearwardly of said forwardly directed digging member;

said pilot member and said secondary member of said plurality of individual digging teeth cooprate together to provide the aforesaid continuous cutting edge.

9. The apparatus of claim 8 wherein said bucket lip includes an elongated, unitary, main member having vertically spaced laterally extending grooves at the rear thereof; said lip includes upper and lower surfaces placed at an acute angle respective to one another to form part of the bottom of the bucket rearwardly of said main member; the forward edge of the upper and lower surfaces being joined to the vertically spaced grooves to present a boxed-in construction.

10. The apparatus of claim 9 and further including spaced vertical web members having an upper edge joined to the upper surface, a lower edge joined to the lower surface, and a forward edge joined to the main member.

11. In an excavating bucket having sidewalls joined to a rear wall and to a bottom to form an outwardly opening, load receiving interior, with a lip being formed at the leading marginal edge of the bucket bottom, a plurality of digging teeth attached to said lip, and lifting means are provided by which the bucket can be manipulated, the improvement comprising:

means by which said plurality of teeth are removably supported by said lip, said lip lying substantially in a plane which is disposed laterally respective to said sidewalls, said bottom joins said lip and rear wall to one another with said bottom being in the form of a curved member which commences in attached relationahip respective to the rear wall and curves toward said lip;

said digging teeth each include a marginal forward cutting end for engaging and excavating the ground, and a rear marginal mounting end which provides part of the means by which the teeth are attached to said lip; said forward cutting end of each of the teeth cooperate together to present a cutting edge which extends from one sidewall to the other of the bucket to thereby provide a continuous cutting edge which prevents the bucket lip from engaging material to be excavated;

each of said teeth include a pilot member and a secondary member, with the pilot member extending in advance of the secondary member, cutting means on the pilot and secondary members for providing advanced and rear cutting edges, the advanced and rear cutting edges of each of the teeth provide for said marginal forward cutting end, and all of said teeth jointly cooperate together to form the before mentioned continuous cutting edge;

the outermost opposed teeth being mirror images of one another with there being a plurality of other teeth positioned between said outermost teeth;

any two adjacent teeth located between said outermost teeth are mirror images of one another and are arranged in side by side substantially abutting relationship; the pilot members of said adjacent teeth cooperate together to present a forwardly directed ground engaging member which is also said advanced cutting edge.

12. The improvement of claim 11 wherein the secondary members of adjacent teeth cooperate together to form said rear cutting edge, which commences at the termination of one advanced cutting edge and continues into the termination of another adjacent advanced cutting edge, with the forwardly directed ground engaging members and the rearwardly located cutting edges jointly cooperative together to form the before mentioned continuous cutting edge.

13. The improvement of claim 11 wherein said bottom which is connected to and extends forwardly from said rear wall is upwardly curved toward said bucket lip, with said lip and teeth being arranged respective to one another and to said bottom such that when said bucket is set down with the teeth and bottom engaging the ground, said teeth are disposed along a common plane which is located at an acute angle respective to the ground so that forward movement of the bucket causes the teeth to engage and excavate earth.

14. The improvement of claim 11 wherein said means by which said teeth are supported by said bucket lip includes an elongated enlargement in the form of a stump which lies in a plane placed laterally respective to the bucket sidewalls and which extends from substantially one side of the bucket to the other side thereof;

each of said digging teeth includes a cavity formed therewithin, said cavity is made of a configuration which is complementary respective to said stump so that said stump can be telescopingly received within said cavity in close tolerance relationship therewith; thereby enabling each of said plurality of teeth to be slidably received in a removable manner by said elongated enlargement of said bucket lip.

15. The improvement of claim 11 wherein said sidewalls are substantially vertical, while said bottom commences at said rear wall and curves downwardly for a marginal length thereof and towards said bucket lip;

each of said sidewalls of the bucket includes an angle member, said angle member includes one end which is attached to an opposed end of said lip, another end which is attached to said bottom, a side which is attached to said rear wall, and another side which is attached to and forms an edge of said side of said bucket, the last said edge being reduced in thickness to form a knife edge for trimming the sidewalls of an excavation.

16. The improvement of claim 11 wherein said bucket lip includes an elongated tooth engaging main member arranged laterally respective to the digging movement of the bucket, and extending from substantially one sidewall to the other sidewall of the bucket; forwardly directed enlargements made integrally with said main member, each tooth having a rearwardly opening cavity made complementary respective to said enlargement, and means by which said digging teeth are mounted in a removable manner on said enlargement.

17. The improvement of claim 16 wherein said main member includes vertically spaced laterally extending grooves, said lip includes interior and exterior surfaces placed at an acute angle respective to one another to join said bucket bottom at the rear thereof; the forward edge of the interior and exterior surfaces being spaced from one another and joined to the vertically spaced grooves to present a boxed-in construction.

18. The improvement of claim 17 and further including spaced vertical web members having an upper edge joined to the interior surface, a lower edge joined to the exterior surface, and a forward edge joined to the main member.

* * * * *